United States Patent [19]

Rumney et al.

[11] Patent Number: 4,813,597

[45] Date of Patent: Mar. 21, 1989

[54] ANTI-ICING SNOWGUN

[75] Inventors: Roger Rumney, Dorset; Rod K. Kessler, Arlington, both of Vt.

[73] Assignee: Rogers Corporation, Dorset, Vt.

[21] Appl. No.: 85,988

[22] Filed: Aug. 17, 1987

[51] Int. Cl.[4] ..... F25C 3/04

[52] U.S. Cl. ..... 239/2.2; 239/14.2; 239/139; 239/428.5; 62/74

[58] Field of Search ..... 239/2.2, 14.2, 132, 239/132.1, 132.5, 139, 397, 5; 62/74, 428.5; 261/76, 78.1

[56] References Cited

U.S. PATENT DOCUMENTS

| | | | |
|---|---|---|---|
| 1,529,562 | 3/1925 | Vezio . | |
| 1,723,082 | 8/1929 | Schumann | 239/129 X |
| 3,464,625 | 9/1969 | Carlsson . | |
| 3,923,246 | 12/1975 | Cloutier et al. | 239/14.2 X |
| 3,923,247 | 12/1975 | White | 239/14.2 |
| 3,945,567 | 3/1976 | Rambach | 239/14.2 |
| 4,145,000 | 3/1979 | Smith et al. | 239/14.2 |
| 4,214,700 | 7/1980 | Vanderkelen et al. | 239/14.2 X |
| 4,275,833 | 7/1981 | Fairband | 239/2.2 |
| 4,465,230 | 8/1984 | Ash | 239/2.2 |

*Primary Examiner*—Andres Kashnikow
*Assistant Examiner*—Kevin P. Weldon
*Attorney, Agent, or Firm*—Schmeiser, Morelle & Watts

[57] ABSTRACT

A snow gun and process for making artificial snow comprising a heat exchanger for holding air and water in separate, adjacent chambers and an ejector manifold that disperses air/water admixture to the ambient atmosphere. A multi-chambered heat exchanger is designed so that incoming water completely envelops the air jacket, thus warming the incoming air. Thereafter the water, generally under pressure, entrains the air through use of a multi-ported manifold, using air ejector phenomenon, and is exhausted to the atmosphere where the expelled air/water admixture dissociates to finely atomized water droplets, which subsequently freeze to form artificial snow.

7 Claims, 4 Drawing Sheets

ANTI-ICING SNOWGUN

FIELD OF THE INVENTION

This invention relates to snow-making apparatus, generally of the snowgun or nozzle type, and in particular to an improved snowgun which uses a compound manifold ejector- nozzle that is welded to and thus integral with an air/water heat exchanger.

BACKGROUND OF THE INVENTION AND PRIOR ART

Voluminous prior art exists regarding snowguns and snow-making apparatus. The preponderance of artifical snow-making devices, many currently in use, operate on the principle of combining (internally) compressed air and water and further, conducting the mixture to nozzle means for atomizing and ejecting it into the ambient air. What at first glance would appear to be a rather simple process is clearly contraverted by the fact that there has been so much past and current activity related to the development of inventions such as the instant one.

Throughout the history of artificial snow making, three major concerns have driven numerous inventors to search wide ranging scientific arts to acquire the ability to: (1) vary the size of the artificial snow crystals; (2) increase the throw trajectories obtainable from traditional nozzles, (given constant pressure fluids); and (3) enchance the overall quality of snow crystal in relation to the type of pack required on any given ski slope. Constantly iterating any development equation drawn to the aforementioned concerns are perhaps more numerous subfactors: the size of a snow crystal is dependent upon ambient air temperature, mixture temperature and exhaust pressure that affect the degree of atomization; throw trajectory is affected by fluid pressures, nozzle geometry and, as specifically addressed in this application, the presence or absence of physical inhibitors such as rime ice forming on the spray heads; and, quality of the snow crystal is dependent upon most of the foregoing factors as well as ambient (outside) air temperatures.

A patent issued to Smith in 1979, U.S. Pat. No. 4,145,000, disclosed a snow-making nozzle assembly which had the purpose of producing uniform, highly atomized droplets of liquid that would freeze in the ambient air to form snow. This invention was concerned primarily with the size and quality of the snow crystals formed; and, the particular nozzle teaching that it embodies is the use of a convergent-divergent compressed air nozzle which, at the diversion portion, entrains water that is inducted at opposed pairs of water outlets spaced at the periphery of the generally fan-shaped convergent-divergent compressed air nozzle. Because of the use of a large quantity of compressed air, this invention appears able to avoid the consequence of rime ice formation at the nozzle exhaust. The consequence of such a device, however, is that additional cost must be expended to provide the high volume of compressed air. To those familiar with the snow-making art, the high cost of compressed air is perhaps the most onerous burden which must be borne.

In 1969, Carlsson was issued U.S. Pat. No. 3,464,625 for a method and means for making snow. This invention combines ejector art with the physical principles of the convergent-divergent nozzle and achieved a satisfactory product of somewhat limited quantity. Carlsson's use of the ejector literally allowed him to develop a device for entraining an annulus of air by a column of water which passed through the center of the air annulus. Since the entrainment principle works best with miscible fluids (such as water and air), Carlsson was able to achieve a quality snow crystal. The disadvantage presented by this art, however, is that the sudden cooling in the divergent section of such a nozzle, especially of the length disclosed in the patent, gives rise to an icing condition which may occur actually within the divergent nozzle. Such icing interfers significantly with the throw trajectory of the snowgun.

In searching diverse art (for analogous features), U.S. Pat. No. 1,529,562, Which was issued to Vezie in 1925 disclosed a Superheating Oil Burner which by a novel combination of a closed cylinder Within a cylinder provided a means whereby liquid fluid (oil) could be heated by gaseous fluid (steam) using the principle of the heat exchanger. As in most of the snowgun art, the gaseous fluid of this invention was used to expel the liquid fluid; nonetheless, this principle, in an earlier pristine form, spurred this inventor to further research and development of the instant invention.

Superficially, patents issued to Ash and Fairbank, U.S. Pat. Nos. 4,465,230 and 4,275,833 respectively, would appear to repeat the art of Vezie. As a closer reading of these patents reveals, however, the inventors are driving a stream of water coaxially through a port in the side of closed cylinder of highly compressed air. Both inventions are apparently avoiding the mixing of the fluids by what Ash terms to be the injection of a column of water (centrally) into a column of air and, in so doing, effect a laminar flow therebetween. In the view of the instant inventor, a most serious disadvantage attends this form of art in that if they attain a laminar flow, the inventions do not mix the fluids (water and air) and therefore failing to achieve any significant control over the degree of atomization, the quality of the snow crystals cannot be varied. Further, in the instant inventor's experience, this apparatus, because it has no designed anti-icing features, suffers from icing and dimished throw trajectory, as does all the prior art.

Although different methods of atomization exist, with varying degrees of efficiency, the primary defect inherent in all of the prior art related to snow-making devices and guns is the inability of these devices to prevent rime icing, at the nozzle, ejection ports or in snowgun heads, at temperatures below 25 degrees Fahrenheit. As ambient temperatures fall below 25 degrees Fahrenheit, the devices of the prior art "ice up" creating a number of problems: (1) the snowgun ejection nozzle becomes partially blocked thus perturbing the throw trajectory; (2) the blockage of the nozzle eventually disrupts the constantcy of snow quality; (3) constant supervision is required to prevent or aleviate these icing conditions; and, (4) freezing of the moisture content of the air inside the snowgun head makes the apparatus inoperable.

The present invention, drawn to and developed to quiet the industry's concerns, combines older, unused principles with novel developments by the inventor and, in so doing, avoids the aforementioned disadvantages.

Through numerous experiments, and the development of devices that have been tested on extant ski slopes in the northeast United States, the inventor determined that the nexus of the aforementioned problems and disadvantages was the inability of the snowmaker to control the temperatures of the fluid ejecta and thereby avoid icing conditions. Since most water used is taken from below grade, its temperature is generally at around 56 degrees Fahrenheit. Air however, having been already compressed, is (already) at ambient temperature. Admittedly, the cooler air would indicate a drier fluid and therefore greater solubility in water; however, such a factor remains more dependent upon the water temperature. The inventor initially reasoned that if the air were warmed slightly, say to water temperature, the admixture of the two fluids were forced (i.e., a forced mixing), and the ejecta solution were expelled into the colder sub-freezing atmosphere, it would be possible to achieve a generally good quality snow using less compressed air and suffer no icing at temperatures below zero degrees Fahrenheit. The instant invention, hereinafter described, achieved these objectives, and more. Production of this invention, as may be readily ascertained by one of ordinary skill viewing the drawings and reading this disclosure, has been embodied in but a few machining and welding processes and results in a most inexpensive and trouble-free product.

SUMMARY OF THE INVENTION

Icing at the ejection ports or nozzle of the snowgun has been virtually eliminated by the present invention. This snowgun is comprised of two salient members; a tri-chambered heat exchanger and an integral multi-ported manifold that communicates directly with two of the chambers and is in partial registry with the third of such chambers.

The heat exchanger member is comprised principally of an innermost water conduit, a second adjacent air conduit and an outermost water conduit. The outermost water conduit is a closed jacket that communicates directly with the open innermost conduit, an open sleeve,so as to effect water flow on both sides of the intermediate or "sandwiched" air jacket (chamber). put simply, the heat exchanger is composed of a water jacket (innermost chamber) Within an air jacket (second chamber), within a water jacket (outermost chamber). The inventor has chosen a physical arrangement similar to the art of Vezie (cf. Background of the Invention and Prior Art) by shaping the three chambers into a series of concentric cylinders. Those of ordinary skill in the art will recognize, however, that it is possible to also perform this art using concentric spheres or boxes. A water inlet, supplying ground water, is presented at the surface of the outermost chamber and an air inlet communicates directly with the second chamber, passing through, but segregated from the outermost water chamber. Additional chambers, effecting more such jacketing can be easily envisioned and designed. For example, the traditional automobile radiator art could provide such heat exchange character.

The second salient member of this apparatus comprises an essentially rectangular bar of material that is welded to the margins of a series of three slots appearing in longitudinal and radial registry in the surfaces of the three chambers. The manifold has what for orientation purposes may be described as back, front, top and bottom lateral surfaces, as well as side surfaces. The back lateral surface of the manifold is welded into the slot of the innermost chamber so that the manifold back surface literally becomes an inner, contiguous surface of the innermost chamber. A series of cross-lateral (front to back) apertures are made in the manifold so that the innermost chamber communicates with the ambient atmosphere The outer surface of the air jacket (second chamber) is sealed to the manifold top and bottom lateral surfaces along the jacket slot margins. In similar manner, the outermost jacket (outermost water chamber) is sealed to the manifold top and bottom lateral surfaces. The ends of the air chamber are closed so that no communication exists between the second chamber (i.e., the air jacket) and the outermost and innermost water chambers. A series of lateral upper and lower ports are provided in the top and bottom surfaces of the manifold within the air jacket that will allow the second chamber to communicate with the water conduits (apertures) that pass from the innermost chamber to the ambient atmosphere.

In operation, water is forced into the outermost chamber surrounding the air jacket (second chamber) and then passes into the innermost chamber, to be Vented through the crosslateral apertures of the manifold. In so doing, the water is restricted from entering the second chamber but effectively is in a registration therewith that will allow the warming of the air chamber walls, on all sides, by a simple contact heat conduction mechanism. Meanwhile, compressed air is brought directly into the second chamber, absorbs heat from the surrounding and internal (relative to the air chamber) water chambers and passes into the upper and lower ports of the manifold to be inducted thereafter by the water, mixed therewith and ejected to the ambient atmosphere.

It should be understood that the foregoing description and summary of the invention, as well as the detailed description which follows, serve only to exemplify the invention in its broadest sense. Those of ordinary skill will recognize that, because of its heat exchange facility and otherwise simple character, this invention will operate under rather adverse conditions. For example, alteration of the air induction (upper and lower) ports can be effected so that air pressures down to that of ambient air could be used. It is the principle of the air ejector that facilitates this particular characteristic. Also, by mechanically varying the water input ports of the manifold, it is possible to meter the input water to allow longer contact times for the fluids in the heat exchanger member and thereby vary the velocity of the ejecta and the throw trajectory.

The following description of the drawings, the description of the preferred embodiments and the claims, together with the foregoing description shall serve to explain further the principles of the invention.

DETAILED DESCRIPTION OF THE PREFERRED EMBODIMENT

Figure 1:
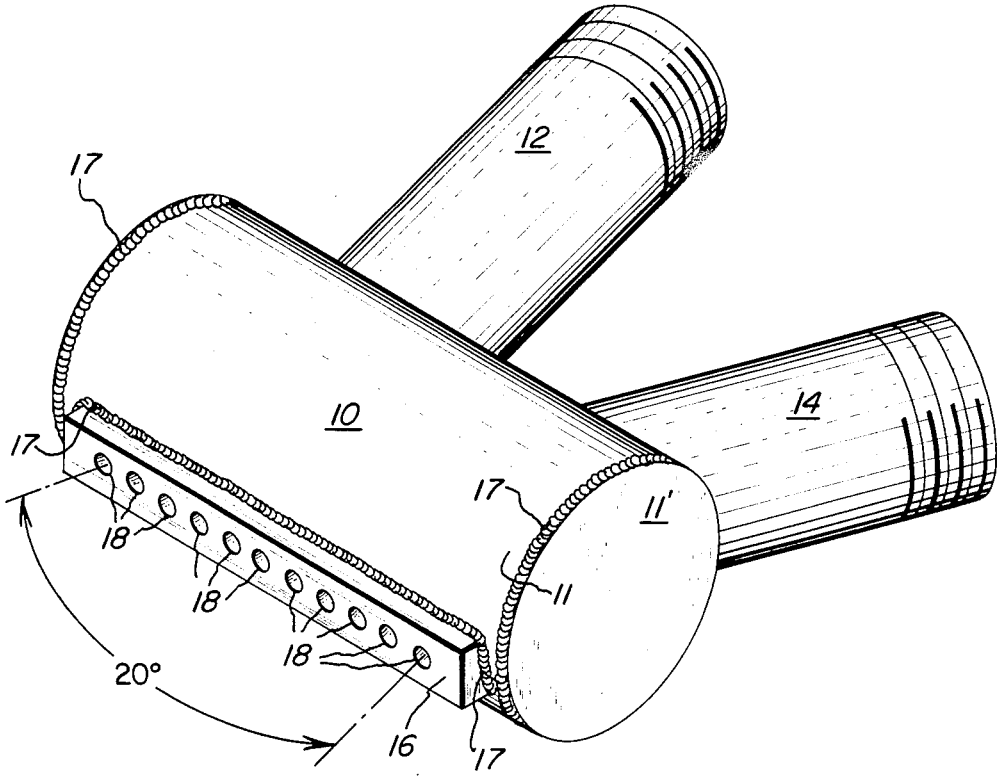
FIG. 1 is an isometric illustration of the invention.

In order to combine in one snow-making gun the most desirable features including, small droplet size, snow making efficiency, enhanced spray pattern (so as not to accumulate large quanities of snow close to the gun) and a true anti-icing operation, a uniquely designed heat exchanger apparatus with an integral ejector manifold has been developed FIG. 1 is a simplified isometric illustration of the external componentry of the invention 10. Reference now being had to FIG. 1, there is depicted the snowgun nozzle 10, in physical appearance a cylindrical housing 11, attached to a water supply 12 and an air supply 14. Manifold 16 comprises an essentially rectangular member that is, in the preferred embodiment, welded to housing 11, as indicated by the presence of weld beads 17 in the illustration. Extant at the surface of the manifold are the several nozzle apertures 18 which communicate with the interior of the snow gun 10. The relatively narrow included angle 20 between the discharge axes of the extreme left-right discharge apertures results from the findings of an exhaustive experimental regimen and has the effect of providing a longer trajectory to the water/air mixture which is being discharged into the atmosphere. This angle, ideally 15–20 degrees, varies significantly from that generally used in the prior art. Those knowledgable in the art of snow making understand that many small orifices (here ports 18) produce an ice crystal more uniform in size and, in so doing, consume less air. Such a technique provides a higher quality snow that is more suitable for snow grooming as well as providing a surface more enjoyable to the skiier. The use of a multi-apertured or many-orificed nozzle therefore requires that considerable consideration be paid to the lateral placement of those nozzles. Use of the aforementioned included angle 20 was found also to give the water particles more "hang time" (i.e. time of suspension in air) in which to freeze, thereby increasing the efficiency of the gun. The natural air currents distribute the crystals and keep then from piling up, thus requiring labor and machinery to distribute the snow after it has been produced. Experimentation with other forms of the prior art having wide discharge angles between nozzles clearly discloses that such guns dump the snow produced much closer to the gun and therefore require more work to distribute the snow evenly.

Figure 2:
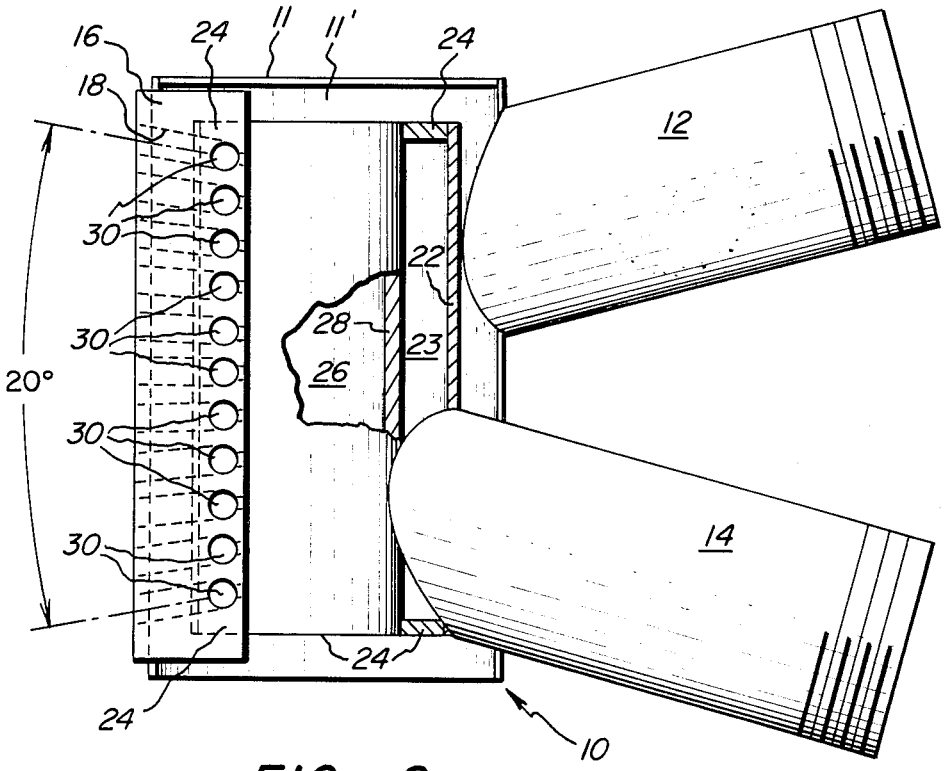
FIG. 2 is a sectionalized top view of the invention.

Detailed investigation into the physics of snow making disclosed to the inventor that the most prominent problem existing in the prior art, interior freezing of the snow gun/nozzles and the external formation of rime icing, could be alleviated by use of the apparatus disclosed in FIG. 2. FIG. 2 is a partially sectionalized top view of the invention 10. It should be viewed in conjunction with FIG. 3 which is a side elevation of the partially sectioned apparatus. For the sake of clarity, no reference lines are shown between the two figures.

Figure 3:
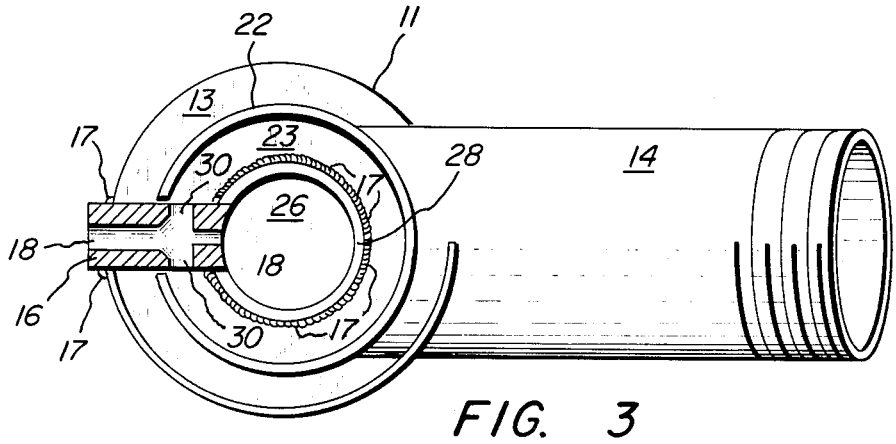
FIG. 3 is a partially sectionalized side elevation of the invention.

Referring more particularly now to FIG. 2, water supply 12 and air supply 14 are seen communicating with the interior of water housing 11 and inner cylinder 22, respectively. Inner cylinder 24, also known as the air jacket, is completely isolated from the housing 11, also known as outer water jacket, by the welded end plates 24. In turn, end plates 24 each form an annulus within air chamber 22 and are joined by a tubular jacket member 28 which allows the creation of a cylindrical (water) chamber 26 within air chamber 22. Thus, the device can be viewed as a chamber within a chamber within a chamber, achieved by concentric cylindrical apparatus and further characterized by an outer chamber containing therein an isolated air chamber 22 which contains therein a chamber 26 that communicates only with outer chamber 11. Thus it may be seen that water flowing from water conduit 12 through outer housing 11 and into outer chamber 13 flows around air chamber 22 and into innermost water chamber 26. In so doing, the heat in the water is transferred, via conduction mechanisms, to the air in air chamber 23 that has been inducted from air conduit 14. A two-fold purpose is accomplished by this heat-sink or heat exchange apparatus. First, the warmed air chamber (generally at ground water temperatures) keeps any condensation in the air chamber from freezing. Tests conducted by the inventor confirmed that guns without a warming water jacket were found susceptible to frequent freezing of air chamber water condensation. This phenomenon occurs generally when ambient temperatures fall below 22 degrees Fahrenheit. The instant invention has consistently operated at temperatures below minus 10 degrees Fahrenheit Without encountering any freezing problems. Use of the warmed air with the ground temperature water also provided the second most desirable characteristic of the instant invention, that of preventing rime ice formation in the nozzles, which will be discussed later in this disclosure Considering FIGS. 2 and 3 together, the ejector manifold 16 shall now be described in greater detail. The manifold 16 is both a water and air distribution manifold and functions on the principle of fluid ejection, that is, the entrainment of one fluid by another. In the preferred embodiment, the manifold is an essentially rectangular piece of material that is placed laterally, i.e. coaxially within one hemisphere of the compound cylindrical arrangement of triple cylinders. Preferably, it is welded 17 at every point where it abuts the cylinders. The interior of the manifold comprises, at several points, orthogonally communicating chambers. The nozzles 18 comprise a set of radial apertures or conduits which communicate the innermost water chamber 26 with the ambient atmosphere. Thus it may be readily seen that water entering through water conduit 12 passes into outermost water chamber 13, around air jacket 22, 24, 28, and into innermost water chamber 26 and, thereafter, out through the multiplicity of conduits 18. FIG. 2 depicts the narrowly divergent paths of conduits 18 effecting an angle of dispersion 20. Both FIGS. 2 and 3 depict the confluence of the water in conduits 18 and air which, after it enter through air conduit 14 is ducted to inner chamber 23 and enters orthogonal air ports 30. Thereafter, air entrained by the water passes out of the apparatus. The conduit-nozzle 18 is therefore more appropriately described as a mixing chamber/nozzle and comprises an ejector type apparatus in which compressed air is entrained by a stream of pressurized water. Once the admixture breaks free of the confinement of nozzles 18, the expanding air creates violent turbulence, literally atomizing the water into fine water droplets. When, these droplets are projected to the ambient atmosphere they freeze and fall as ice crystals. Because the air and water are at approximately the same temperatures, super cooling, due to the rapid expansion of the air, does not take place until the admixture has exited nozzles 18. Consequently, no rime ice forms at the conduit-nozzle orifices.

Figure 4:
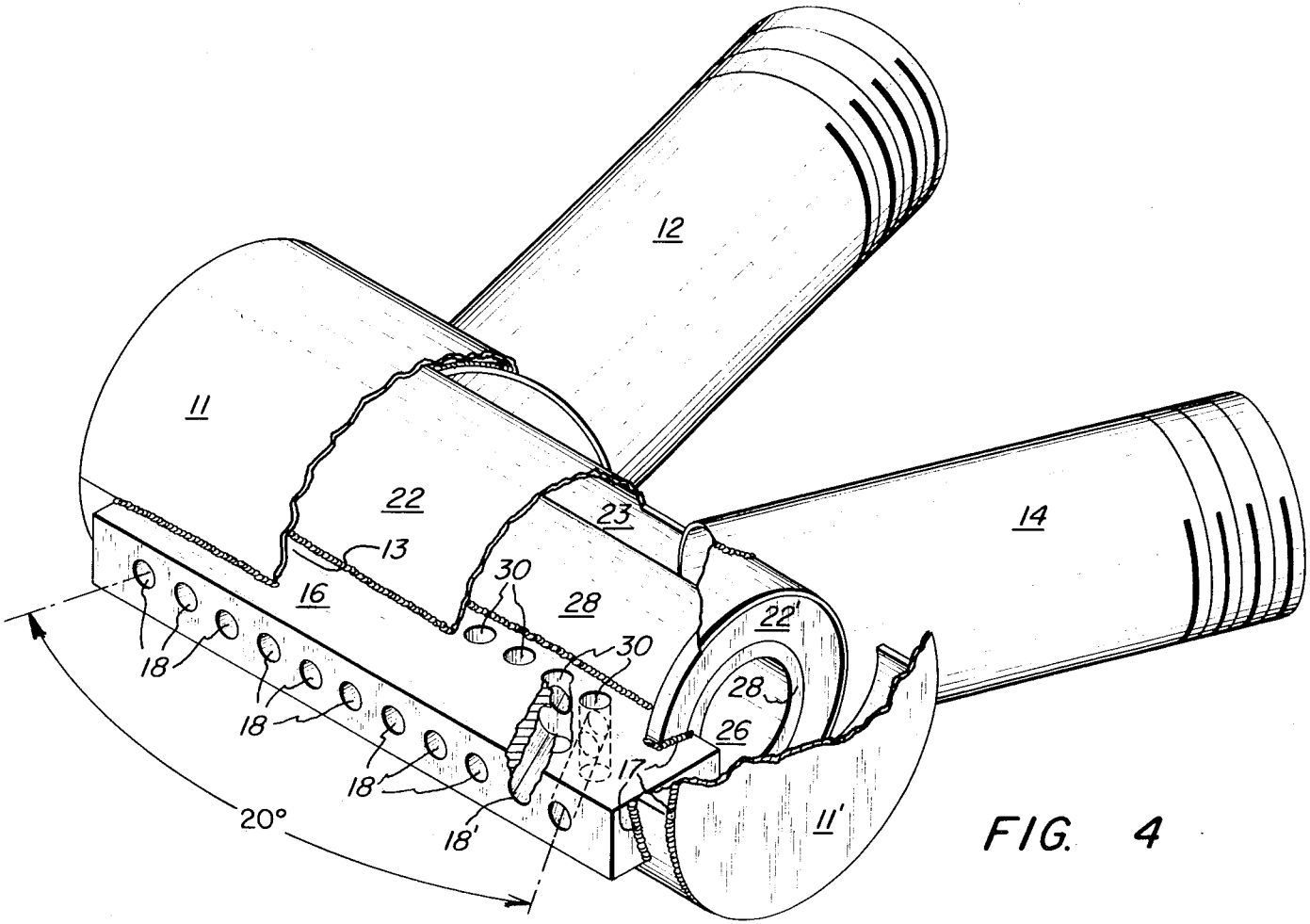
FIG. 4 is a sectionalized isometric view of the invention.

FIG. 4, a partially sectionalized isometric view of the invention shall now be used to more fully explain the novel features of this unique snowgun. The partially sectionalized (cut away) isometric illustration of FIG. 4 depicts the main componentry of the invention. The most prominent features that are disclosed in this illustration are the housing or outermost cylinder 11 and the surface of the middle jacket 22 which establish the outer water chamber 13, and the air chamber 23, established between middle chamber surface 22 and innermost chamber surface 28. It may be readily seen that water entering conduit 12 passing into the outermost water jacket 13 is allowed to flow around the air chamber 23 sealed ends 22 and into the innermost chamber 26. Consistent with the aforementioned ducting, the water then flows out of chamber 26 via water ports 18 that are in themselves conduits from chamber 26 to the ambient atmosphere. During this route, the ground temperature (water) completely envelops and surrounds the closed air chamber 23 and, by the process of conduction, transfers the water heat through surfaces 22 and 28 to the air in chamber 23 contained within the air jacket. The warmed air, bearing no lesser moisture content than at its inlet 14, is then inducted at ports 30 by the water streaming through conduits-nozzles 18 and expelled to the ambient atmosphere. The entrainment process, typical of fluid ejectors, comprises a turbulent mixture of the fluids (air and water). Although not as efficient, it is possible to decrease the pressure of air being used and rely entirely upon the principle of fluid entrainment to carry the admixture to the ambient atmosphere. A special cut-away feature 18' discloses the confluent structure of manifold 16 as orthogonal apertures/ports 18/30 create a plurality of mixing chambers within the manifold. Extreme (left and right) nozzles 18 are indicated as having a predetermined angle of divergence 20. As mentioned earlier, throw trajectory of the manufactured snow is as dependent upon this angle of divergence 20 as it is on the pressure of the water and air flows that are used.

Figure 5:
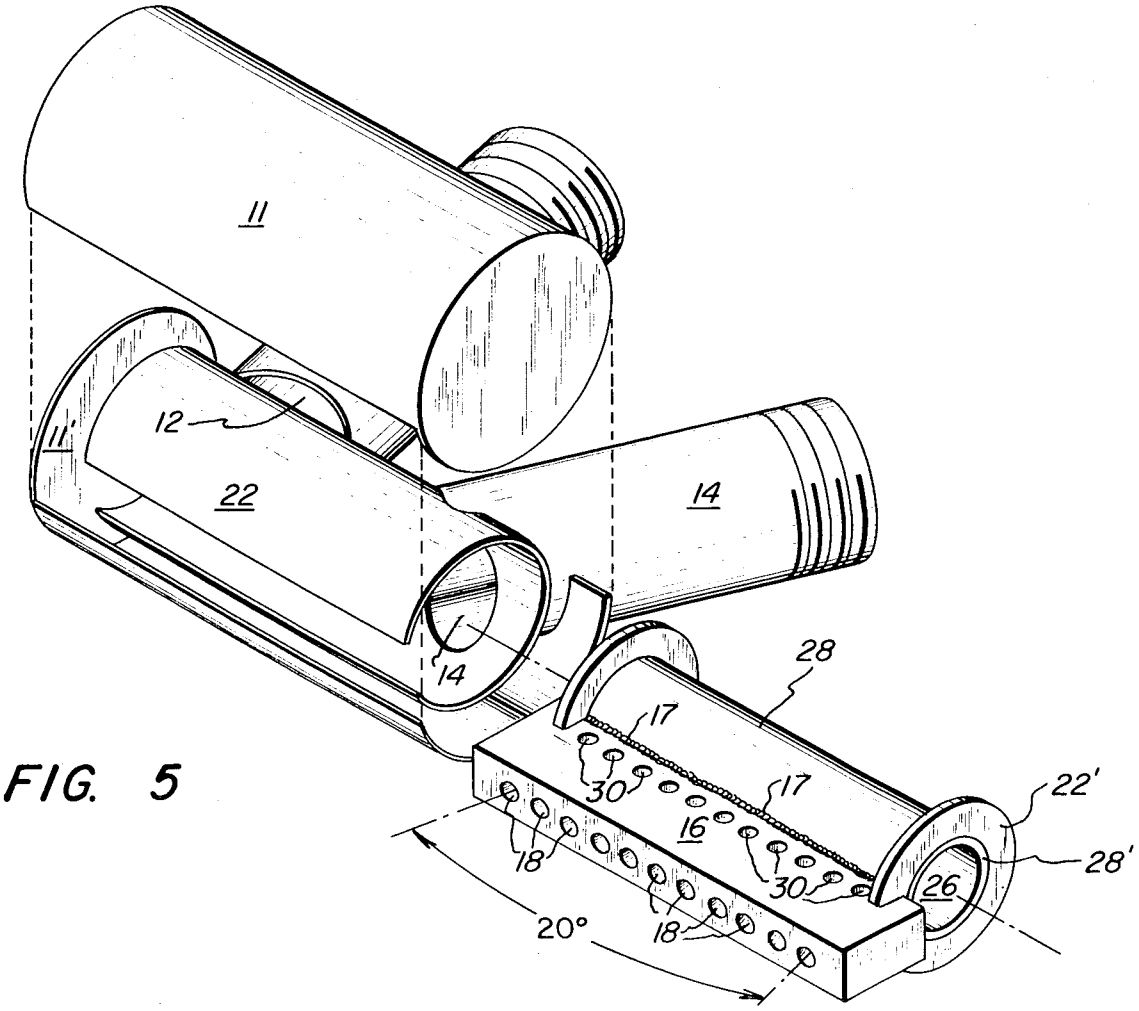
FIG. 5 is an isometric exploded view of the invention.

FIG. 5 is an exploded isometric drawing of the invention that gives perhaps the clearest picture of the salient elements of the invention. In fact, the inventor has found this to be illustrative of the most reasonable production process of the invention. Inner water chamber 26 is first realized by constructing innermost jacket 28 and welding to it the premanufactured manifold 16 containing orthogonal pre-machined nozzles 18 and air induction ports 30. Flanges 22 are (properly) the end pieces of air jacket 22. In this illustration, it may be readily seen that air conduit 14 terminates on air jacket 22 and spills its contents into the space 23 between jacket 22 and innermost jacket 28 to expose it directly to air induction ports 30. If the reader will visualize the placement of jackets 28 into and concentric with, jacket 22 so that manifold 16 fits into the slots of housing 11 and jacket 22, it becomes readily apparent that water entering through water conduit 12 will completely envelope the volume defined by housing 11, jacket 22, 22' and the inside of the chamber defined by jacket 28, 28'. In the preferred method of manufacture, the inventor uses steel for construction and connects the salient elements, e.g., the manifold 16 to innermost jacket 28, by welding 17. This is an advance over the current state-of-the-art snowguns that are typically cast from aluminum. Aluminum, being very soft by comparison with steel, is susceptible to distortion when the operators remove ice from guns (normally) with hammers. Further, removal of a fitting from an aluminum casting invariably begins a destruction process on the aluminum threads because of gaulding. Further, the instant invention, being a snowgun of all-welded construction, is devoid of the usual gaskets and O-rings which can leak.

The combining of heat exchanger with an ejector manifold has clearly lent new dimension to the art of snow making. Those versed in this art shall find that, by use of the invention, they are able to achieve large volumes of a higher quality product. More importantly, the user of the instant invention will discover that it is completely functional at temperatures well below zero degrees Fahrenheit. Other modifications will become apparent to the inveterate snow maker such as, perhaps, the addition of other chambers to enhance the heat exchange capability, or varying the nozzle array as well as the angle of divergence. Thus, the invention in its broader aspects is not limited to the specific embodiments herein shown and described but modifications and variations may be made thereon within the scope of the accompanying claims, without departing from the principle of the invention herein described.

What is claimed:

1. An artificial snow-making apparatus having water and air inlets for supplying water and air thereto and comprising:

a heat exchanger for holding ingressing air and water in separate, adjacent chambers in registry to conduct heat therebetween, said exchanger comprising three concentric cylindrical housings defining three concentric cylindrical chambers of which at least two of said chambers communicate with the ambient atmosphere;

and an ejector manifold integral with said heat exchanger comprising a body having therein at least one external aperture for communicating simultaneously with an air and a water chamber of said exchanger and for conducting water out of one of said chambers into said manifold to induce said air thereto and spray both said air and water into the ambient atmosphere, whereby air passing into said exchanger is warmed by water also passing into said exchanger, by conduction of heat from said water chamber to the entire surface of said air chamber, and whereby said water may subsequently induct said air as it passes out of said exchanger to the ambient atmosphere through said aperture simultaneously communicating said air with said water.

2. The invention of claim 1 wherein said heat exchanger further comprises first housing means containing second housing means therein and third housing means contained within said second housing means and wherein a fist chamber is defined between said first and said second housing means, a second chamber is defined between said second and said third housing means, and a third chamber is the interior of said third housing means.

3. The invention of claim 2 wherein said first chamber and said third chamber are in communication with each other and said second chamber is isolated therefrom but adjacent to and in heat transfer registry with said first and said second chambers.

4. The ejector manifold of claim 1 comprising a body of predetermined length to span a portion of the surfaces of said first housing means, said second housing means and said third housing means and further in physical continguous radial registry With all said housing means so as to be integral therewith and having therein at least one aperture for communicating between said third chamber, said second chamber and the ambient atmosphere.

5. The invention of claim 4 Wherein said aperture further comprises a conduit that communicates With said third chamber and said atmosphere and also communicates at one point along its length with said second chamber.

6. A process for making snow comprising the steps of:

introducing pressurized water and air separately into a concentric cylinder tri-chambered heat exchanger means that will hold said water and air separate but in proximity to each other so that at least one air chamber is completely surrounded by water chambers and so as to conduct heat therebetween said air chamber and said water chambers; and spraying said water out of said exchanger to the ambient atmosphere spraying inducing said air into said water spray to be simultaneously projected therewith.

7. The process of claim 6 wherein the step of ducting comprises inducing air by said water through air ejector means.

* * * * *

UNITED STATES PATENT AND TRADEMARK OFFICE

CERTIFICATE OF CORRECTION

PATENT NO. : 4,813,597

DATED : 21 March 1989

INVENTOR(S) : RUMNEY et al.

It is certified that error appears in the above-identified patent and that said Letters Patent is hereby corrected as shown below:

At Claim 6, line 11, between the words "atmosphere" and "spraying", add --,said--.

Signed and Sealed this

Twenty-eighth Day of November 1989

*Attest:*

JEFFREY M. SAMUELS

*Attesting Officer*

*Acting Commissioner of Patents and Trademarks*